US005934282A

United States Patent [19]

Young, III et al.

[11] Patent Number: 5,934,282

[45] Date of Patent: Aug. 10, 1999

[54] HINGED SPINE BOARD

[75] Inventors: Robert Mark Young, III, Ceres, Calif.; Eric J. Eskilson, Lawrence, Kans.

[73] Assignee: Robert Mark Young III, Escalon, Calif.

[21] Appl. No.: 08/926,668

[22] Filed: Sep. 9, 1997

Related U.S. Application Data

[63] Continuation of application No. 08/600,825, Feb. 13, 1996, abandoned.

[51] Int. Cl.[6] ..... A61G 15/00

[52] U.S. Cl. ..... 128/870; 5/627

[58] Field of Search ..... 128/845, 846, 128/869, 870, 876; 5/627, 628, 111, 114

[56] References Cited

U.S. PATENT DOCUMENTS

| | | | |
|---|---|---|---|
| 765,369 | 7/1904 | Smith | 5/627 |
| 0,765,369 | 7/1904 | Smith | 5/627 |
| 1,857,008 | 5/1932 | Adcock | 5/627 |
| 2,201,890 | 5/1940 | Dunn | 5/627 |
| 2,242,311 | 5/1941 | Lucey | 5/627 |
| 2,276,256 | 3/1942 | Visness | 5/627 |
| 2,328,047 | 8/1943 | Anderson | 5/627 |
| 2,377,940 | 6/1945 | Hughes | 5/82 |
| 2,396,931 | 3/1946 | Schmid | 5/627 |
| 2,675,564 | 4/1954 | Hughes | 5/627 |
| 3,151,343 | 10/1964 | McCormick | 5/82 |
| 3,648,305 | 3/1972 | Ersek | 5/82 |
| 3,678,921 | 7/1972 | Brendgord et al. | 128/1 R |
| 4,369,982 | 1/1983 | Hein et al. | 280/47.13 R |
| 4,665,908 | 5/1987 | Calkin | 128/134 |

*Primary Examiner*—Michael A. Brown
*Attorney, Agent, or Firm*—Limbach & Limbach LLP

[57] ABSTRACT

A spine board for use in supporting a patient during emergency medical treatment comprising a pair of board joined together by a hinge. The hinge is provided with a latch which allows the board to be rigidly locked in a flat condition so as to provide rigid support for a patient receiving CPR or other treatment.

11 Claims, 10 Drawing Sheets

HINGED SPINE BOARD

This is a continuation of application Ser. No. 08/600,825 filed on Feb. 13, 1996 now abandoned.

FIELD OF THE INVENTION

The present invention relates to the field of emergency medical equipment and, specifically, to the field of spine boards for supporting patients during emergency medical treatment.

BACKGROUND OF THE INVENTION

Patients requiring emergency medical assistance are often transported to a hospital by ambulance or other emergency vehicle such as a helicopter. The patient is normally positioned on a gurney, which is a collapsible bed mounted on a set of wheels. The gurney includes a mattress and a frame supporting the mattress. The frame is adjustable between a flat condition, which corresponds to a laying down position for the patient, and an angled condition which corresponds to a sitting up position for the patient. In the angled condition, the portion of the mattress beneath the patient's legs and pelvic region remains flat, while the portion of the mattress beneath the patient's torso, shoulders, and head angles upwardly from the flat portion.

Should a patient suffer a cardiac arrest during transport to the hospital, it is necessary for emergency medical personnel to administer cardiopulmonary resuscitation ("CPR"). CPR involves the application of firm manual thrusts to the patient's chest. A patient receiving CPR must be in a supine position (i.e. laying flat on his or her back). Moreover, application of CPR requires that there be rigid support beneath the patient so that maximum force from the manual thrusts is received by the patients chest rather than absorbed by a flexible structure beneath the patient.

CPR is difficult to administer to a patient on a gurney, because of the soft mattress beneath the patient and also because the gurney frame is not completely rigid and thus deflects slightly in response to the thrusts on the patient's chest. It is normally necessary, therefore, for emergency personnel to slide a rigid back board (normally a single piece of thick, rigid ply wood) between the patient's back and the gurney before CPR is administered.

The back board provides sufficient rigidity for the application of CPR to the patient, but it nevertheless presents some difficulties. For example, there is normally little room in the patient transport section of a helicopter or ambulance for manipulation of a back board, particularly if the patient is connected to an oxygen supply or intravenous medication. Moreover, speedy administration of CPR is critical when a patient has suffered cardiac arrest, and so the time needed to lift the patient and position the back board between the patient and the gurney can be detrimental to the patient's health. It is therefore desirable to provide a means for providing the rigid support beneath a patient that is needed during administration of CPR, that is easily used in a small area such as the back of an ambulance, and that requires a minimal amount of time to prepare for administration of CPR.

SUMMARY OF THE INVENTION

The present invention is a spine board for use in supporting a patient during emergency medical treatment. The spine board comprises a pair of boards joined together by a hinge. The hinge is provided with a latch which allows the board to be rigidly locked in a flat condition so as to provide rigid support for a patient receiving CPR or other treatment.

BRIEF DESCRIPTION OF THE DRAWINGS

FIGS. 1C and 1D are side elevation views of the hinge section of the hinged spine board of FIG. 1A, in which FIG. 1C shows the hinge in a latched condition and FIG. 1D shows the hinge in an unlatched condition.

DETAILED DESCRIPTION OF THE PREFERRED EMBODIMENT

Figure 1A:
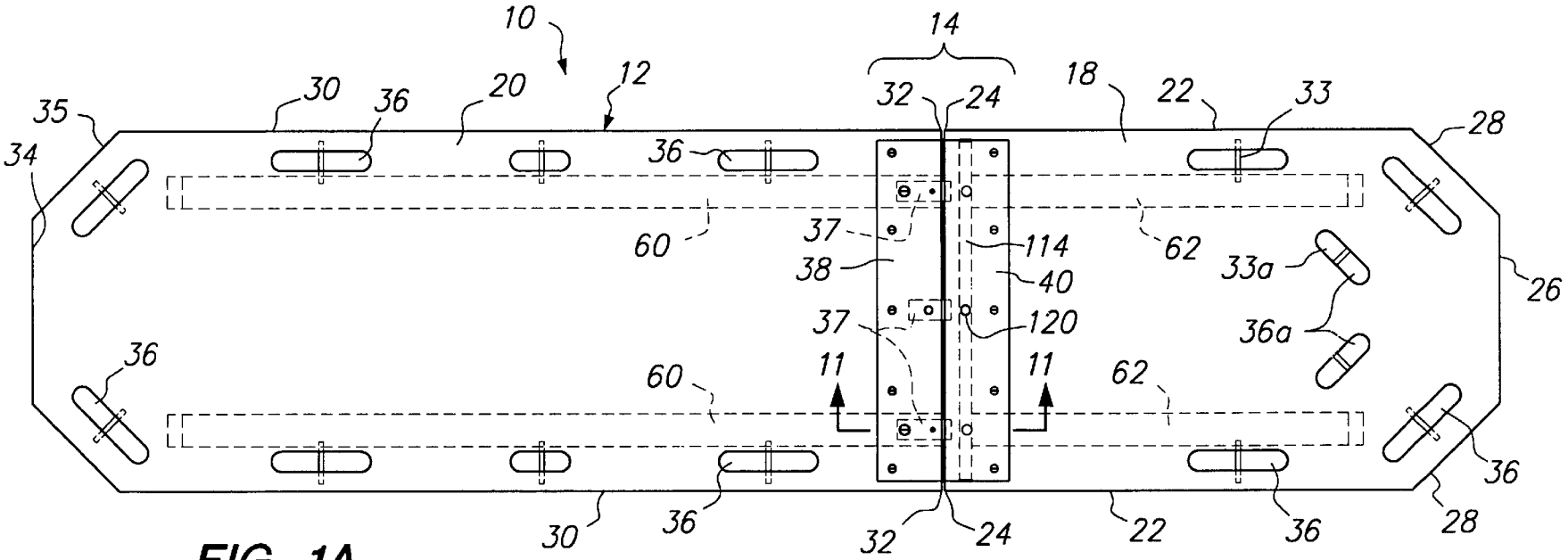
FIGS. 1A and 1B are a top plan view and a side elevation view, respectively, of a hinged spine board according to the present invention.

Referring to FIG. 1A, the preferred spine board 10 of the present invention is comprised generally of a patient support board 12, a hinge 14, and a latch assembly 16. As will be described in detail below, the support board 12 includes a short board 18 and a long board 20 hinged together at hinge 14. By pivoting short board 18 relative to long board 20 at hinge 14, a patient positioned on the spine board may be elevated to a sitting position or lowered to a lying position. The latch assembly 16 allows the board 10 to be rigidly latched after the patient is lowered to a lying position so that cardiopulmonary resuscitation can be performed if needed.

Figure 2:
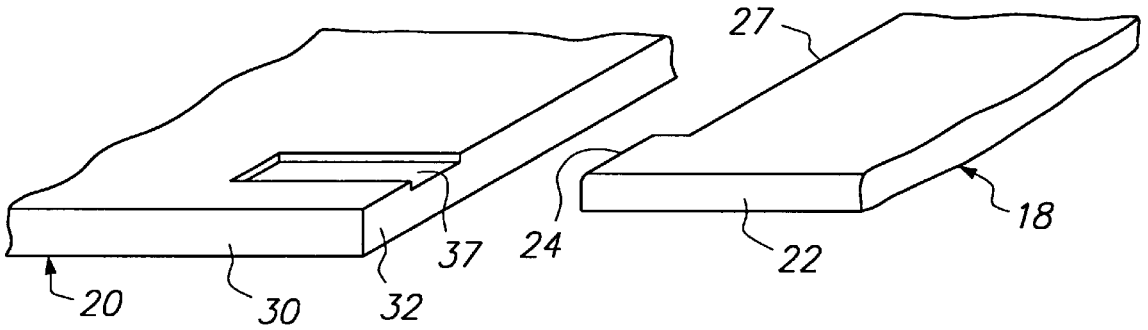
FIG. 2 is a partial perspective view showing a portion of the long board and a portion of the short board of the hinged spine board of FIG. 1A, with the hinge and other components not shown.

Short board 18 of the support board 12 is the portion of the board which during use supports the patient's head, shoulders and arms, and upper torso. Long board 20 is designed to support the patient from approximately the waist down. Referring to FIG. 1A, short board 18 is comprised of a pair of substantially parallel long sides 22, a first short side 24 which is adjacent to long board 20, and a second short side 26 which comprises the head end of the board 12. Angled corner sections 28 connect the long sides 22 with the short side 26. Short board 18 is preferably approximately 2-¼ feet long by approximately 1-½ feet wide. Referring to FIG. 2, short board 18 includes a recessed portion 27 centered along short side 24.

Long board 20 is similar in design to the short board 18. Referring to FIG. 1A, long board 20 has parallel long sides 30, a first short side 32 adjacent to first short side 24 of the short board 18, and a second short side 34 which corresponds to the foot end of the board. Angled corner sections 35 connect the long sides 30 with the short side 34. The long board is preferably approximately 3-¾ feet long by 1-½ feet wide. As can be seen in FIGS. 1A and 2, three spaced recesses 37 (one of which is shown in FIG. 2) are preferably formed on the surface of long board 20, along short side 32.

Short board 18 and long board 20 are preferably formed of rigid wood, such as ¾ inch thick plywood, dimensional lumber, or other rigid materials such as those used for standard backboards. To assist emergency medical personnel in carrying the spine board, a plurality of cut-outs 36 are formed in both the short board 18 and the long board 20 to be used as hand holds. Rods 33 extend across the hand holds and are secured in the boards 18, 20. During use, when it is often necessary to strap a patient onto the board using straps, the straps are fed through the cutouts 36. The user selects which cutouts 36 are used and which side of the rods 33 the straps are to be positioned so that the straps will cross the patient at a location that will securely hold the patient without injuring him or her. Moreover, the straps may be looped around the rods 33 to secure the straps in place.

Figure 15B:
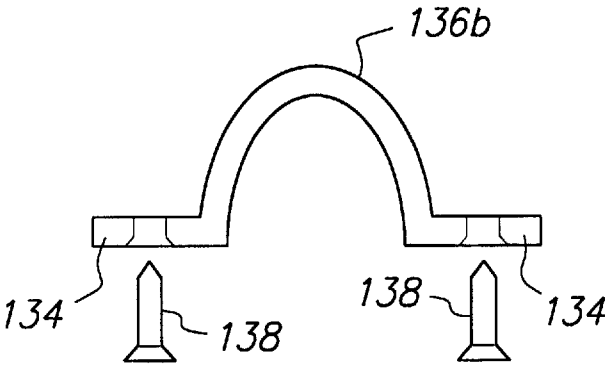
FIGS. 15A and 15B are side elevation views of rod members according to the present invention.
Figure 15A:
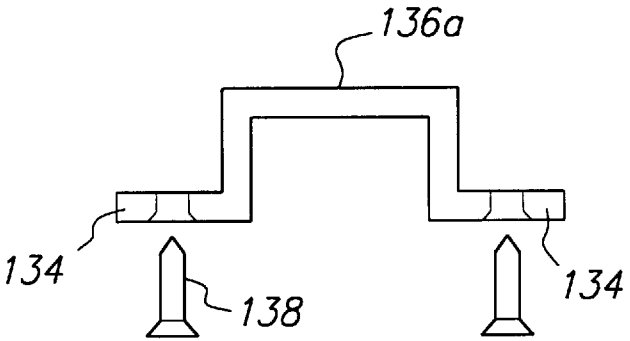

Additional cutouts 36*a* are formed in the short board 18 as shown in FIG. 1A. These cutouts 36*a* provide an additional location for the threading of straps. Their location is particularly beneficial for positioning straps which are to extend over a patient's shoulders. Rod members 33*a* are positioned in the cutouts 36*a*. Rod members 33*a* may be straight rods like the rods 33, or they may have the shape shown in FIGS. 15A or 15B, which comprises a pair of straight sections 134 and a center section which may be rectangular (see center section 136*a* of FIG. 15A) or curved (see center section 136*b* of FIG. 15B). Rod members 33*a* are positioned with straight sections secured by screws 138 to the underside of board 18 such that the center sections 136*a*, 136*b* extend through the cutouts 133*a*. The center sections 136*a*, 136*b* provide loops around which the straps may be secured to the board.

Hinge Section

Figure 3:
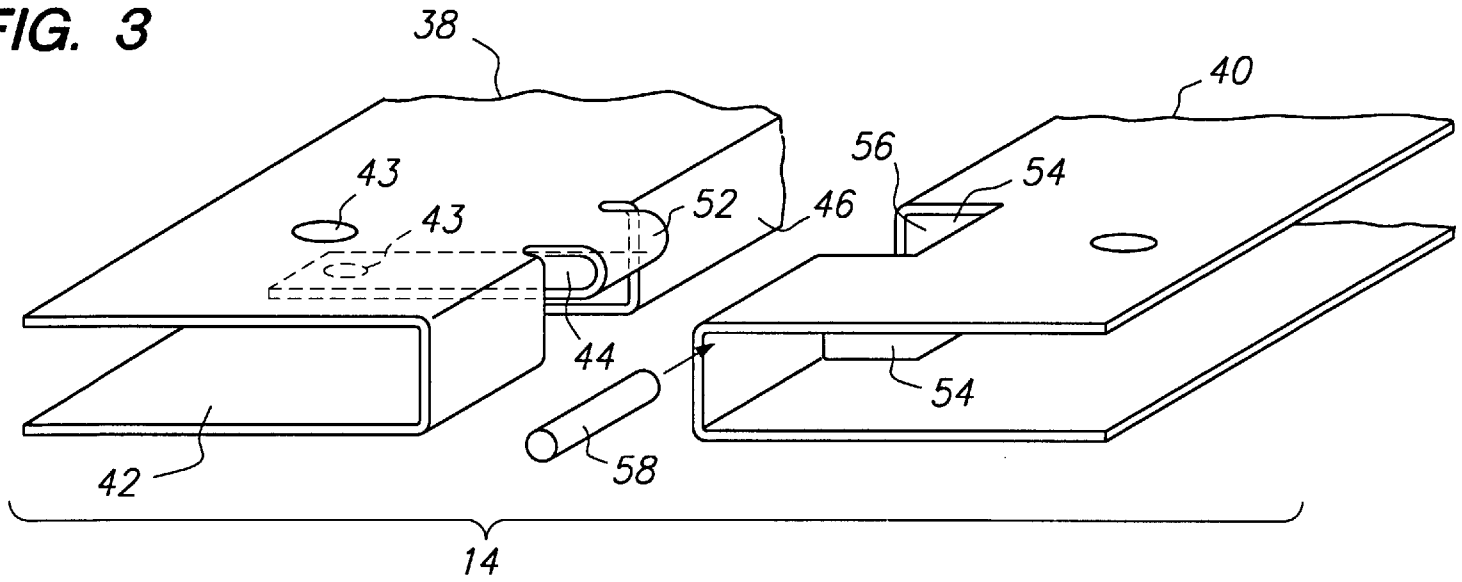
FIG. 3 is a partial perspective view showing a portion of the tabbed hinge section and a portion of the socketed hinge section of the hinged spine board of FIG. 1A.

Referring to FIGS. 1A and 3, hinge 14 is comprised generally of a tabbed hinged portion 38 and a socketed hinge portion 40. Tabbed hinged portion 38 is preferably comprised of a rectangular plate having a U-shaped cross-section and fitted around the first short side 32 (FIG. 2) of long board section 20.

Figure 4D:
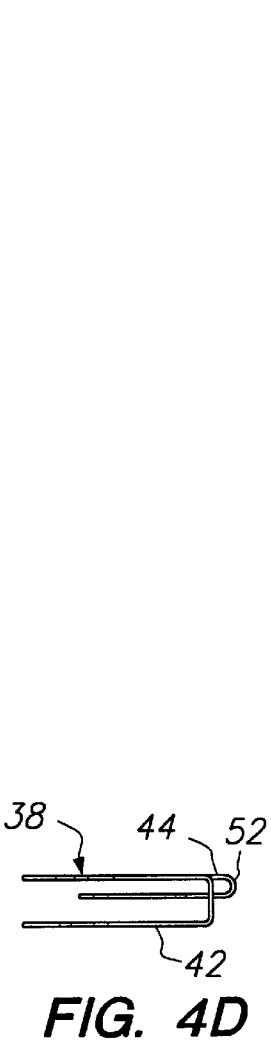
FIGS. 4C and 4D are a top plan view and a side elevation view, respectively of the tabbed hinged portion of FIG. 4B.
Figure 4C:
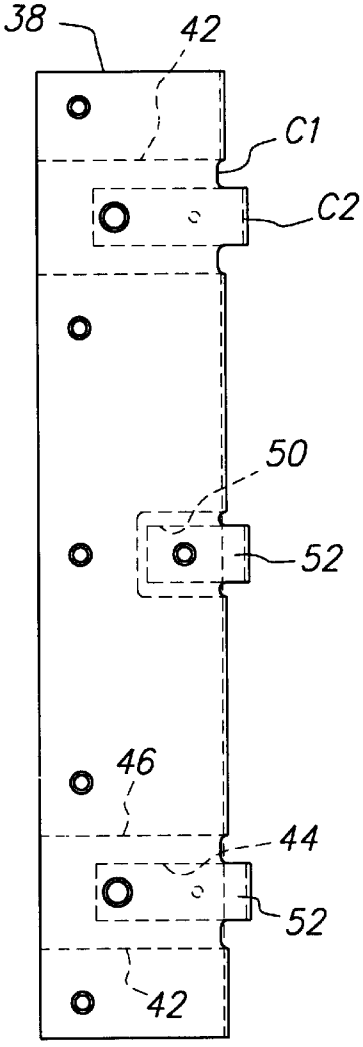
Figure 4B:
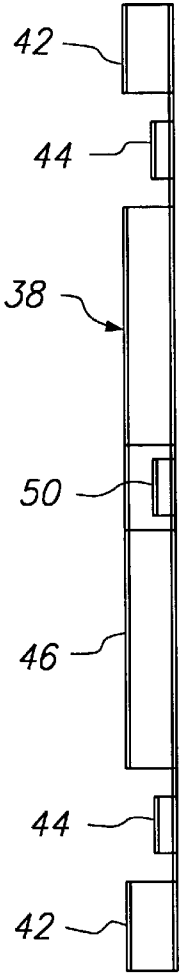
FIG. 4B is a side elevation view of the tabbed hinge portion of FIG. 4A after it has been folded into the U-shaped configuration.
Figure 4A:
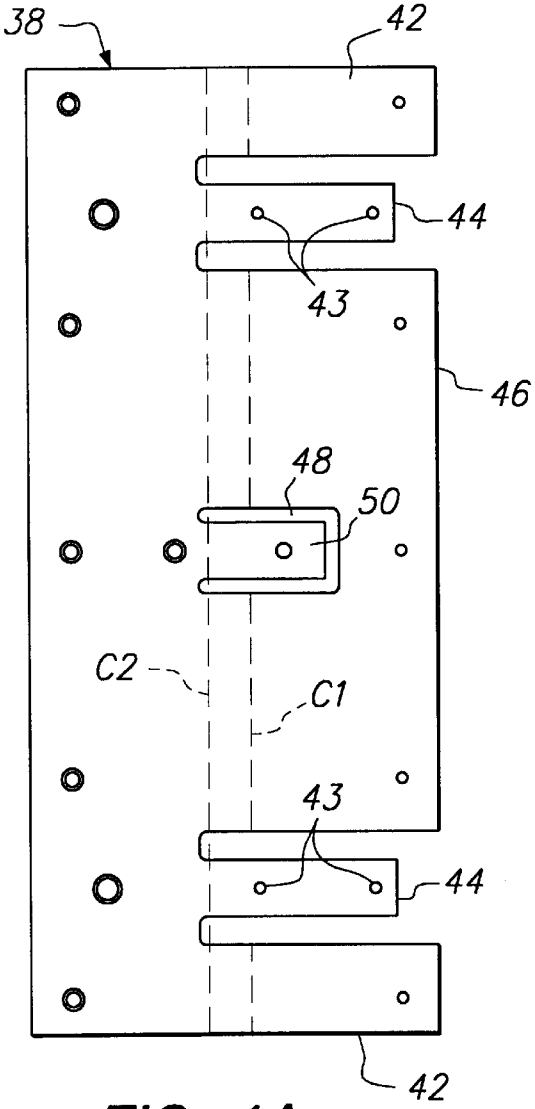
FIG. 4A is a top plan view of the tabbed hinge portion of the hinged spine table of FIG. 1A showing the tabbed hinged portion before it is folded over into a U-shaped configuration.

FIG. 4A shows tabbed hinged portion 38 in its flattened condition, i.e., before it is bent into the U-shape shown in FIG. 3. Cut into the tabbed hinge portion 38 are a pair of end tabs 42, a pair of intermediate tabs 44, each positioned adjacent to one of the end tabs 42, and a rectangular center portion 46. Within rectangular center portion 46 is a U-shaped cutout 48 which surrounds a center tab 50. Tabs 42 and rectangular center portion 46 are folded over themselves at right angles at the creases designated C1 and C2 in FIG. 4A, to form a U-shaped cross-section which conforms to the substantially squared short side 32 (FIG. 1A) of board section 20. Intermediate tabs 44 and center tab 50 are folded over themselves only at crease C1, which gives their corresponding folds short radii of curvature (see FIGS. 2 and 4D). Referring to FIGS. 3, 4C and 4D, folded tabs 44 and 50 form fingers 52 which protrude slightly from the remainder of the tabbed hinged portion 38.

Figure 5B:
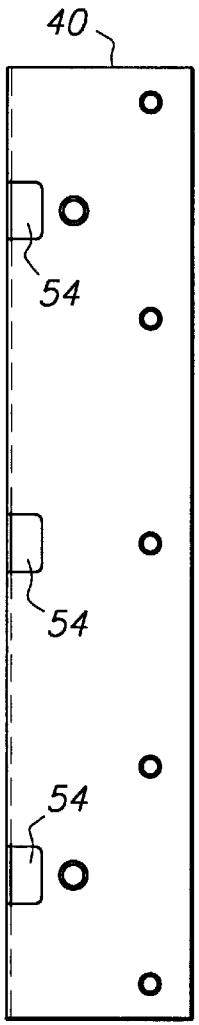
FIG. 5B is a top plan view of the socketed hinge portion of FIG. 5A after it has been folded over into the U-shaped configuration.
Figure 5A:
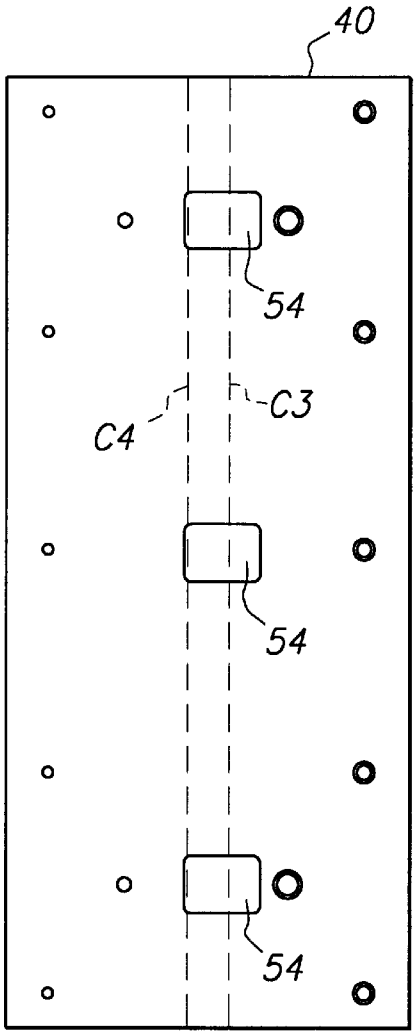
FIG. 5A is a top plan view of a socketed hinge portion of the hinge spine board of FIG. 1A, showing the socketed hinge portion before it is folded over into a U-shaped configuration.

Referring again to FIG. 3, socketed hinge portion 40 is a substantially rectangular plate bent to have into a U-shaped cross-section. The rectangular plate, which is shown in a flattened condition (i.e. prior to bending into the U-shaped configuration) in FIG. 5A, includes three spaced rectangular cutouts 54. The hinge portion 40 is folded over itself at approximate right angles at creases C3 and C4, resulting in the U-shaped cross-section shown in FIG. 3. The "U" of the hinge portion 40 is positioned over end 24 of short board 18.

Referring to FIG. 3, when the hinge portion 40 is bent into the U-configuration, the cutouts 54 form sockets 56. When the board 10 is assembled, fingers 52 of hinge portion 38 are disposed within sockets 56 and extend to recess 27 (FIG. 2) of short board 18. An elongate pin 58 (FIG. 3) passes between hinged portion 40 and recess 27 of short board 18 and also through the fingers 52 to hinge the long board and short board sections together.

In the preferred embodiment, the hinge portions 38, 40 are preferably made of a rigid material such as ¼ inch thick stainless steel.

Latch Assembly

Figure 1B:
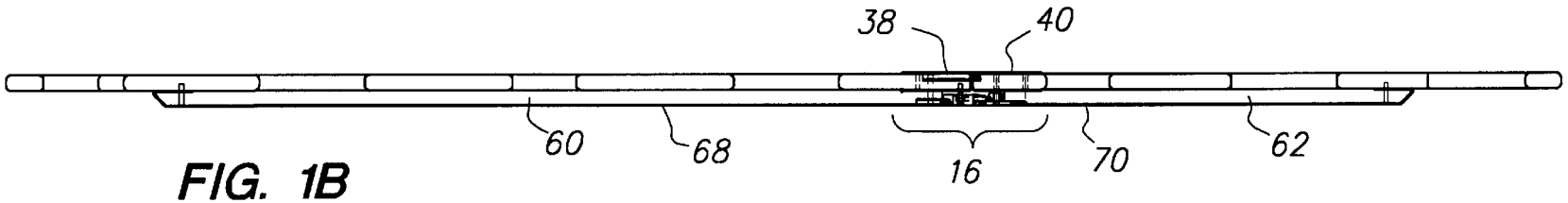
Figure 1C:
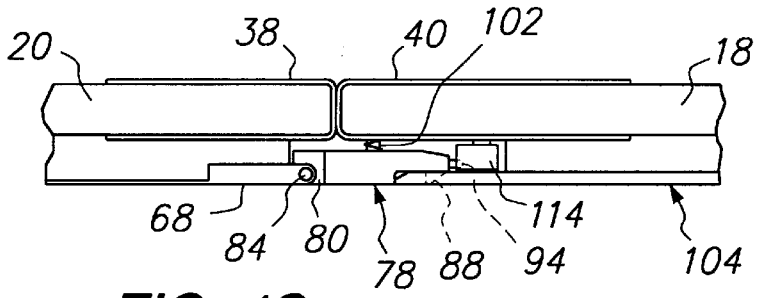
Figure 11:
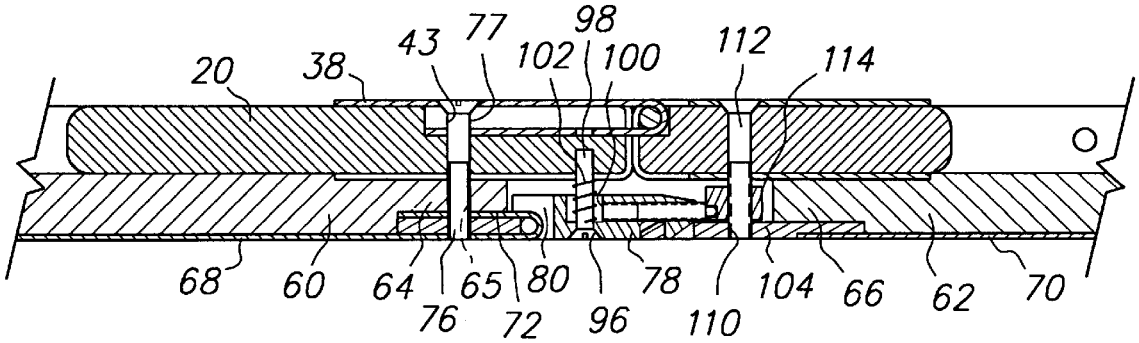
FIG. 11 is a cross-sectional side elevation view of the hinged spine board taken along the plane designated 11—11 in FIG. 1A.

Referring to FIGS. 1A and 1B, wooden runners 60, 62 extend longitudinally along both the long board and the short board. In the figures, the runners on the long board 20 are designated 60, and the short board 18 runners are designated 62. As can be seen in FIG. 11, runner 60 has a protruding section 64 extending in the direction of the runner 62. A bore 65 passes through protruding section 64 in a normal direction. Runner 62 has a protruding section 66 extending towards runner 60.

Figure 6:
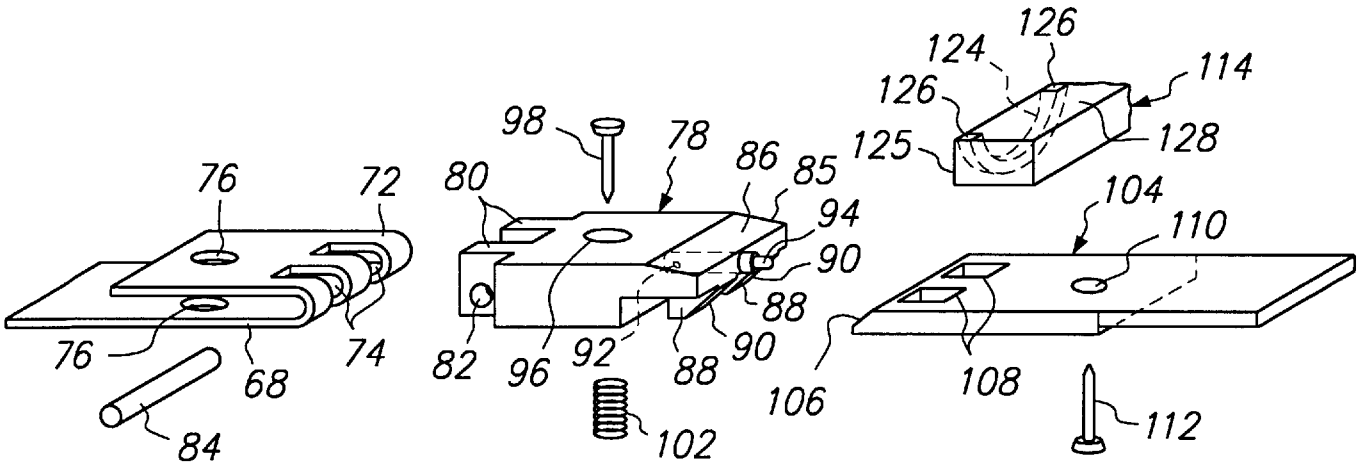
FIG. 6 is an exploded partial perspective view showing a portion of a long board strip, a latch member, a latch plate, and a portion of a release member of the hinged spine board of FIG. 1A.

As shown in FIGS. 1B and 11, stainless steel strips 68, 70 are preferably attached to the undersides of each of the runners 60, 62, respectively. One of the strips 68 for the long board 20 is shown in FIG. 6. Each strip 68 includes a folded over section 72 having a pair of window cutouts 74. Strip 68 further includes a pair of through holes 76 which, which the board is assembled, are aligned with holes 43 on hinge portion 38 (FIG. 3) and bore 65 in runner 60 (FIG. 11). As shown in FIG. 11, a screw 77 extends through the holes 43, 76 and the bore 65 to hold the hinge 38, long board 20, runner 60 and strip 68 together.

Figure 7A:
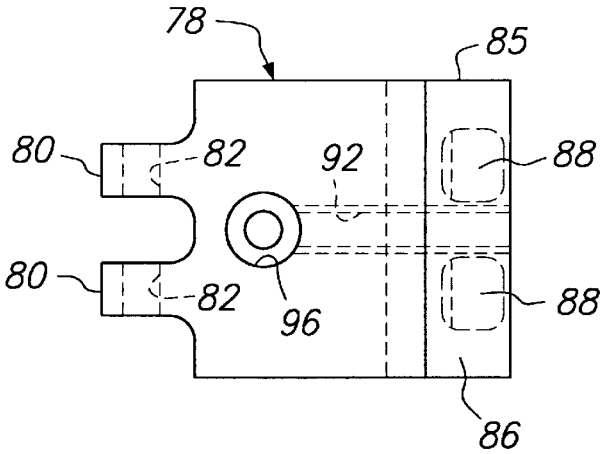
FIGS. 7A and 7B are a top plan view and a side elevation view, respectively, of a latch member of the hinged spine board of FIG. 1A.
Figure 7B:
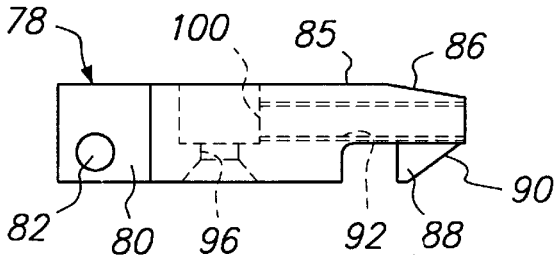

A pair of latches are provided, each of which is operably associated with a corresponding one of the strips 68. Referring to FIGS. 6, 7A, and 7B, each latch 78 has a pair of prongs 80, which, when the board is assembled, are positioned within the window openings 74 of strip 68 (FIG. 6). Bores 82 formed in each of the prongs 80 receive an elongate pin 84 (FIG. 6) to form a pivotally hinged connection between the strip 68 and the latch 78.

Each latch 78 has a forward end 85 having a beveled upper surface 86 and a pair of downwardly extending hook members 88. Each hook member has a beveled face 90 (FIGS. 6 and 7B) which is preferably beveled at an angle of 30°.

A bore 92 is formed in the forward end 85 and houses a spring plunger 94 (FIG. 6). A second bore 96 having a broadened section 100 (FIG. 7B) is formed in the latch 78. As shown in FIGS. 6 and 11, the bore 96 receives a machine screw 98 which is surrounded by a compression spring 102 at broadened section 100. Screw 98 is secured to the long board 20, and the latch 78 is slidable over the screw 98. Thus, latch 78 may pivot about pin 84 and, when latch 78 is made to pivot about pin 84, latch 78 slides over the screw 98. Moreover, when latch 78 pivots towards the board 20, it compresses spring 102.

Figure 8:
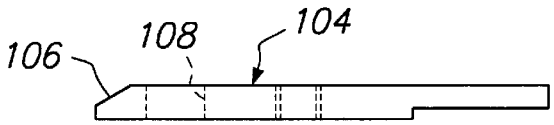
FIG. 8 is a side elevation view of a latch plate of the hinged spine board of FIG. 1A.

Each runner 62 has a latch plate 104 (FIGS. 6 and 8) connected to it. Each latch plate 104 has a beveled end 106, which is preferably beveled to an angle of approximately 30°, extending toward the latch 78 (FIG. 6). Near the beveled end 106 is a pair of rectangular cutouts 108. The cutouts 108 are proportioned to receive the hook members 88 of the latch 78 (FIG. 6) to latch the board 12 (FIG. 1A) in the flat (lying down) position. A through hole 110 (FIG. 6) extends normally through the latch plate 104.

Figure 10:
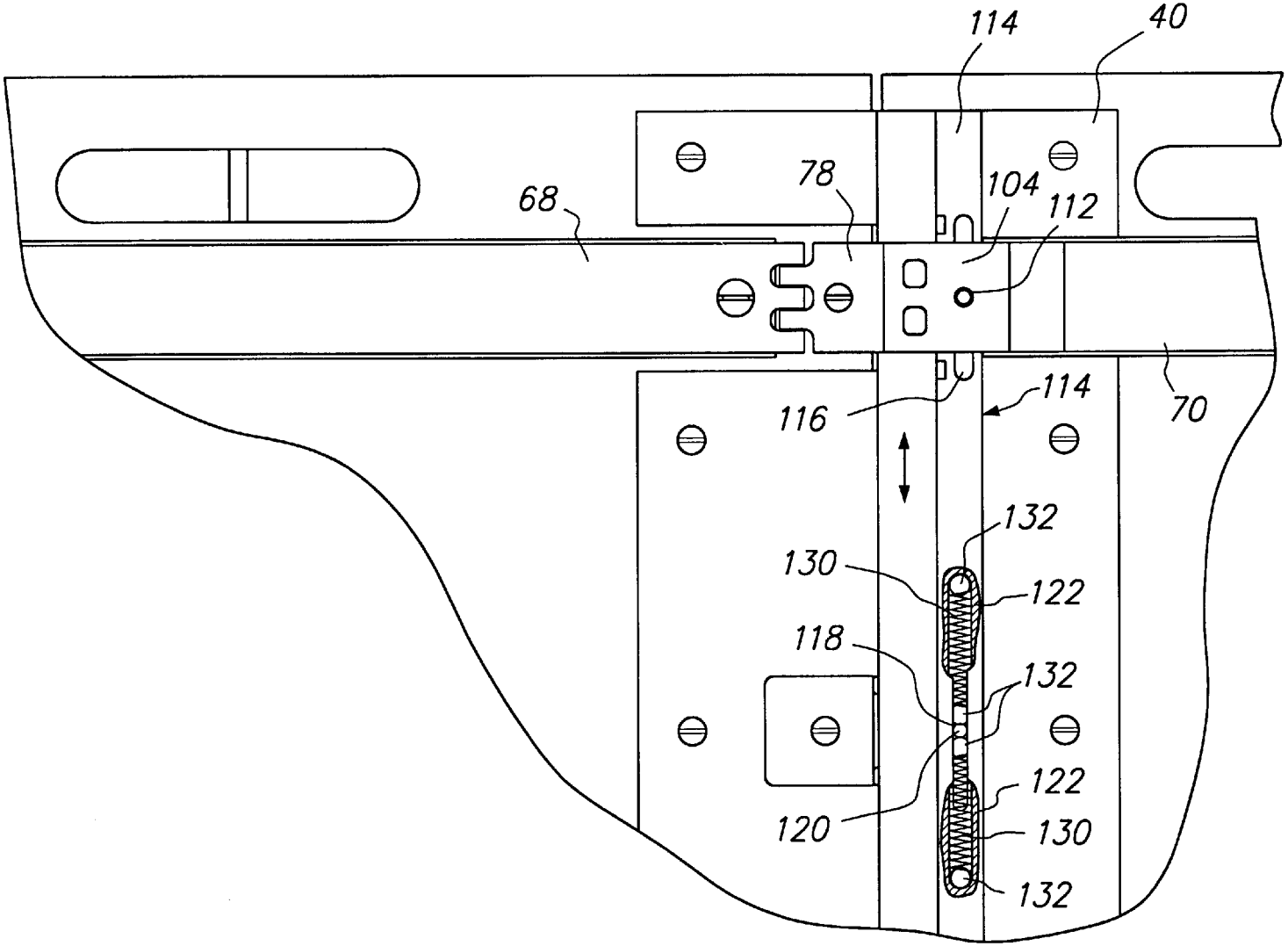
FIG. 10 is a partial plan view of the underside of the hinged spine board of FIG. 1A, in which a portion of the release member is broken away to show the centering springs.
Figure 12:
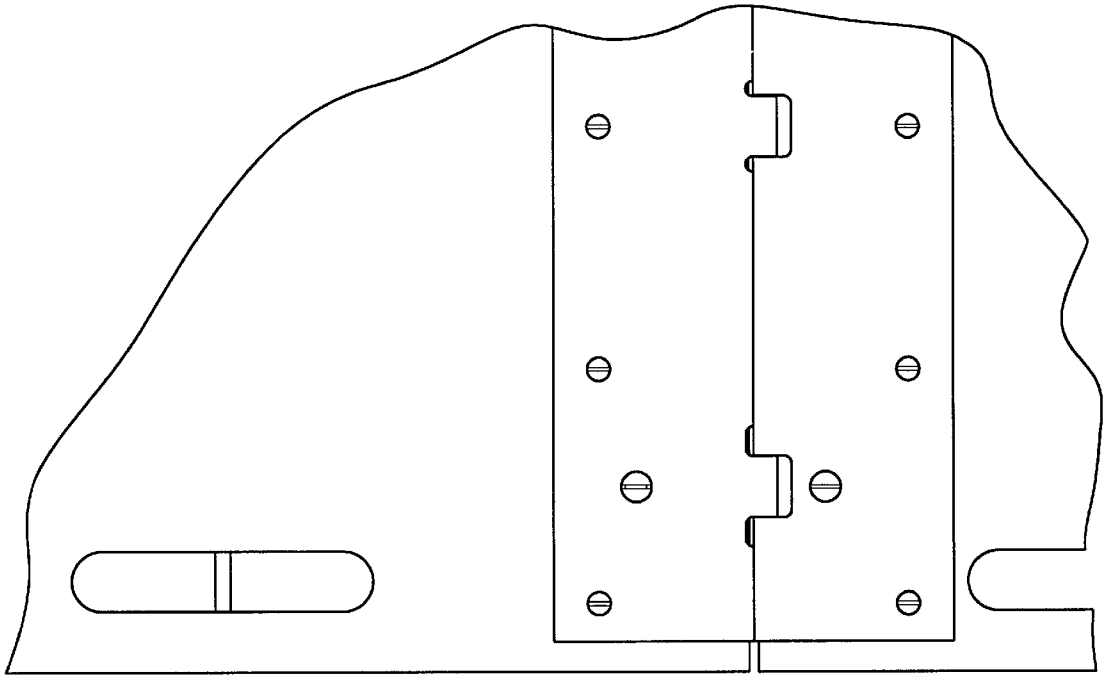
FIG. 12 is a partial side elevation view of the hinged spine board of FIG. 1A, showing the latch assembly in a latched condition.
Figure 12:
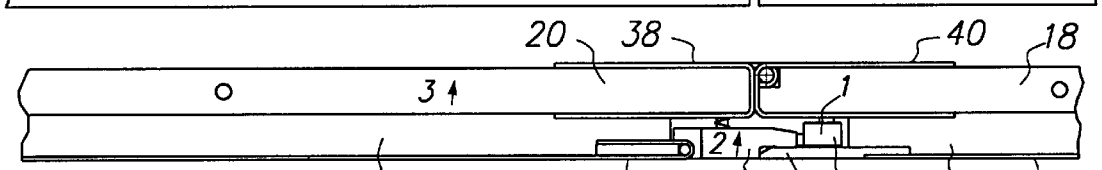

An elongate release member 114 (FIGS. 1A, 6, and 11) is slidably attached to hinge plate 40 as shown in FIG. 10. An elongate plastic member (not shown) may be sandwiched between the release member 114 and hinge plate 40 to provide a relatively low friction sliding surface for the release member 114.

Figure 9A:
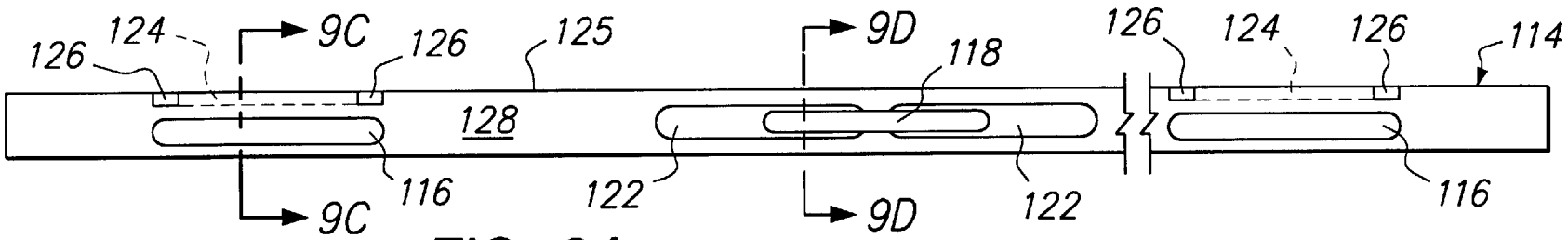
FIGS. 9A and 9B are a top plan view and a side elevation view, respectively, of a release member of the hinged spine board of FIG. 1A.
Figure 9B:
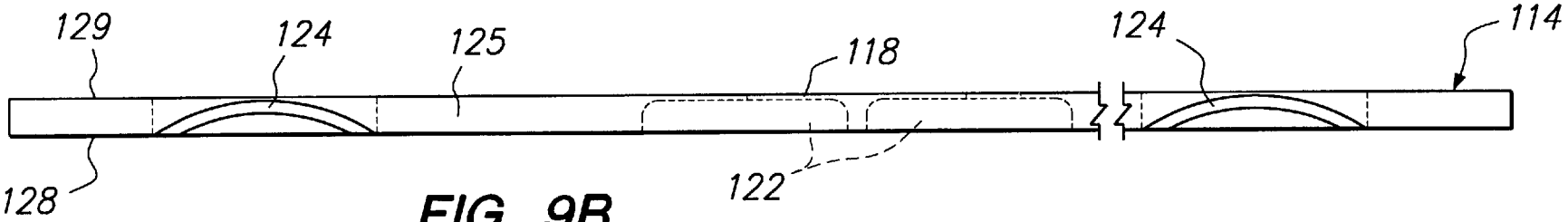
Figure 9C:
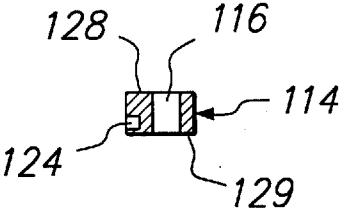
FIGS. 9C and 9D are cross-sectional side views taken along the planes designated 9C—9C and 9D—9D, respectively, in FIG. 9A.

Referring to FIGS. 9A, 9C and 10, a pair of elongate slots 116 are formed through the release member 114 and extend from top face 128 to bottom face 129 of the release member 114. Each slot 116 slidably receives one of a pair fixed screws 112 (FIGS. 10 and 11), each of which extends through through holes 110 (FIG. 6) of a corresponding one of the latch plates 104. Release member 114 is slidable in a side to side direction. When it slides, the slots 116 slide relative to the screws 112, with the screws remaining stationary.

Figure 9D:
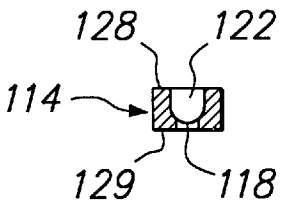
Figure 13:
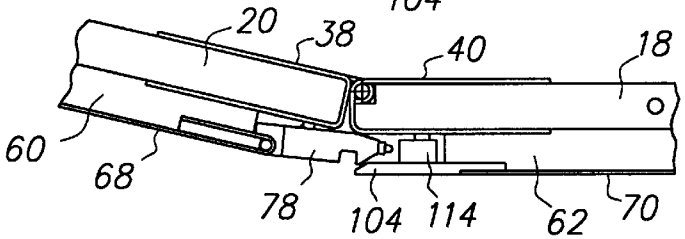
FIG. 13 is a side elevation view similar to the view of FIG. 12 showing the latch assembly in an unlatched configuration.

A center slot 118 (FIGS. 9A, 9B,and 9D) is formed in the release member 114 and extends between top's bottom faces 128, 129. A third fixed screw 120 (FIG. 10) extends through hinge plate 40 and board 18, (FIG. 13) and has its head disposed within center slot 118.

A pair of channels 122 are formed near the center of top face 128 release member 114, each partially overlapping center slot 118. A pair of arcuate grooves 124 are formed in a side 125 of the release member 114, which is the side that faces latch 78 (see FIG. 6). Each of the arcuate grooves 124 has a pair of ends 126 located at top face 128 of the release member 114. The arcuate grooves 124 are positioned such that the tip of each spring plunger 94 (FIG. 6) rests within a corresponding one of the arcuate grooves 124 and such that each spring plunger tip 94 remains within the corresponding groove 124 as the release member 114 is moved side to side. Because of the arcuate shape of the grooves 124, side to side movement of the release member 114 results in vertical displacement (i.e. displacement towards or away from top face 128) of the spring plunger 94.

Referring to FIG. 10, side to side motion of the release member 114 is controlled by means of centering springs 130 and ball bearings 132 positioned in the channels 122 of the release member 114. Centering springs 130 bias the release member 114 so that it is laterally centered on the short board 18. When the release member 114 is centered on the short board, spring plungers 94 are centered along arcuate grooves 124 (FIG. 9B). When the release member 114 is manually pushed in one or the other direction, the screw 120 remains stationary while the release member 114 slides relative to it, causing compression of one of the centering springs 130 between the screw 120 and the opposite edge of the channel 122 within which the compressed spring is positioned. When manual pressure on the release member 114 is released, the centering springs 130 move the release member 114 back into a centered condition.

Because of the arcuate shape of the groves 124, lateral movement of the release member 114 causes elevation of each spring plunger 94 to one or the other of the ends 126 of arcuate groove 124. Because each end 126 is at the top face 128 of the release member 114, this causes each spring plunger 94 to pass out of the arcuate groove 124 via an end 126, and thereby unlatches the short and long boards from one another. The short board can then be pivoted upwardly for positioning of a patient in a seated position.

Operation

Figure 14:
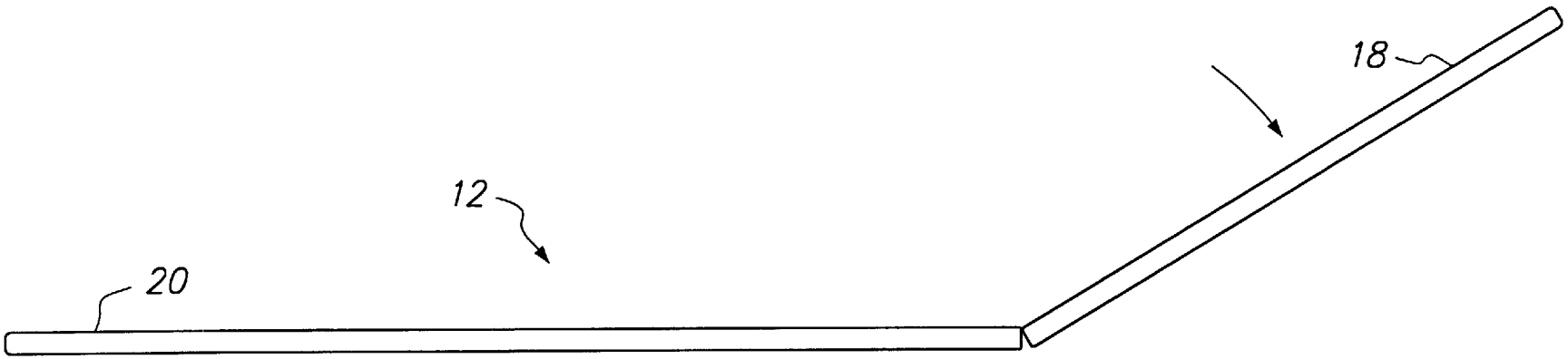
FIG. 14 is a schematic representation of the spine board of FIG. 1A in the upright condition.

Operation of the preferred hinged spine board according to the present invention will next be described. Assume a patient is positioned on the spine board 12 with the spine board in the upright position as shown in FIG. 14. Normally, the spine board will be positioned on a gurney which is also in an upright position. The gurney supports the spine board in the upright position, although the spine board may be provided to include a latch for latching the spine board in an upright position.

Figure 1D:
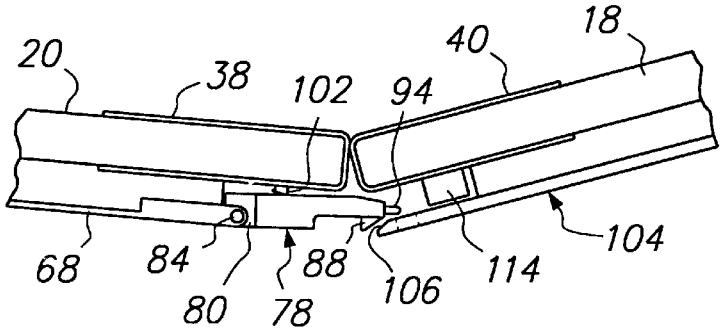

If it should become necessary to move the patient to a lying down position, the medical personnel tending to the patient must push short section 18 of the spine board in the direction indicated by the arrow in FIG. 14, causing board section 18 to pivot about board section 20. Referring to FIG. 1D, as board section 18 is pivoted, the beveled ends 106 of latch plates 104 approach the beveled faces 90 of hook members. Eventually, the spring plungers 94 of the latches 78 contact the beveled ends 106 of the latch plates 104. This contact between the spring plungers 94 and the latch plates 104 causes the latches 78 to deflect slightly against springs 102. Next, beveled ends 106 contact beveled faces 90 of the hook members 88 and cause further movement of the latches 78 against the springs 102. As the board 18 is further pivoted, the beveled ends 106 slide over the beveled faces 90 until the hook members 88 become engaged in the cutouts 108 in the latch plates 104. At the same time, the plunger 94 makes contact with (and is compressed against) a portion of the release member 114.

When the hook members 88 become engaged in the cutouts 108, latches 78 pivot away from the board 20 and thus release the compression of springs 102. This pivotal movement causes the plungers to slide along the surface of release member 114 until they slip into the arcuate grooves 124 on the release members 114. As described above, the plungers 94 rest within the center points (which, in FIG. 6, corresponds to the lowermost point) of the arcuate grooves 124. At this point, the spine board is latched in the flat position and thus provides a flat and rigid surface beneath the patient.

To move the portion 18 spine board back to the upright condition shown in FIG. 14, the release member 114, is manually depressed causing it to slide laterally. During lateral movement of the release member 114, the arcuate grooves 124 slide with respect to the spring plunger 94. Because of the arcuate shape of the grooves 124, side to side movement of the release member 114 results in vertical displacement (i.e. displacement towards top face 128 shown in FIG. 6) of the spring plunger 94. Such lateral movement of the release member 114 thus causes elevation of each spring plunger 94 to one or the other of the ends 126 of arcuate groove 124. Because each end 126 is at the top face 128 (FIG. 6) of the release member 114, this causes each spring plunger 94 to pass out of the arcuate groove 124 via an end 126 in the groove, and thereby unlatches the short and long boards from one another.

We claim:

1. A patient support board comprising:

a first board;

a second board hinged to the first board, at least one of the first and second boards moveable between a first condition in which the first and second boards form a substantially flat patient support surface and a second condition in which the first and second boards form an angular patient support surface; and a latch including a latch plate connected to and extending beneath the first board and a latch receiving portion connected to and extending beneath the second board, the latch plate automatically engageable with the latch receiving portion upon relative movement of the first and second boards into the first condition.

2. A patient support board comprising:

a first board;

a second board hinged to the first board to form a hinged portion of the patient support board, at least one of the first and second boards moveable between a first condition in which the first and second boards form a substantially flat patient support surface and a second condition in which the first and second boards form an angular patient support surface;

a latch including a first latch portion connected to the first board and a second latch portion automatically engageable with the second board upon relative movement of the first and second boards into the first condition; and first and second plates attached to the first and second patient support boards, respectively, to reinforce the hinged portion of the patient support board when the first and second patient support boards are in the first condition, for minimizing deflection of the hinged portion during application of cardiopulmonary resuscitation to a patient positioned on the patient support board.

3. In a patient support board of the type for supporting a patient during emergency medical procedures, the improvement comprising:

a hinge connecting a first portion of the board to a second portion of the board such that at least one of the first and second board sections is moveable between a first condition in which the first and second board sections form a substantially flat patient support surface and a second condition in which the first and second board sections form an angular patient support surface; and a latch including a latch plate connected to and extending beneath the first board and a latch receiving portion connected to and extending beneath the second board, the latch plate automatically engageable with the latch receiving portion upon relative movement of the first and second boards into the first condition.

4. The patient support board of claim 3 wherein the hinge is located at a hinged portion of the board and wherein the improvement further comprises plates attached to the first and second patient support boards to reinforce the hinged portion of the patient support board when the first and second patient support boards are in the first condition, for minimizing deflection of the hinged portion during application of cardiopulmonary resuscitation to a patient positioned on the patient support board.

5. A patient support board comprising:

a first board;

a second board;

a hinge hinging the first board to the second board, such that at least one of the first and second boards is moveable between a first condition in which the first and second boards form a substantially flat patient support surface and a second condition in which the first and second boards form an angular patient support surface, the hinge including a first plate connected to the first board, the first plate including at least two sockets, and a second plate connected to the second board, the second plate having at least two fingers extending into the sockets and pivotally connected to the second plate; and a latch including a first latch portion connected to the first board and a second latch portion engageable with and disengageable from the second board when the first and second boards are in the first condition.

6. A patient support board comprising:

a first board;

a second board hinged to the first board, at least one of the first and second boards moveable between a first condition in which the first and second boards form a substantially flat patient support surface and a second condition in which the first and second boards form an angular patient support surface; and a latch including a first latch portion connected to the first board and a second latch portion engageable with and disengageable from the second board when the first and second boards are in the first condition, wherein the first latch portion includes a latch plate having a latch engaging surface, a release member spring biased in a centered position and laterally moveable relative to the first board between the centered position and first and second positions and wherein the release member further has an arcuate groove having a pair of groove ends and a groove center, and the second latch portion includes a hook engageable with the latch plate engaging surface and a tip engageable with the arcuate groove, the tip disposed at the groove center when the release member is in the centered position and disengageable from the arcuate groove at one or the other of the groove ends when the release member is in the first or second position.

7. A patient support board comprising:

a first board;

a second board;

a hinge hinging the first board to the second board to form a hinged portion of the patient support board, at least one of the first and second boards moveable between a first condition in which the first and second boards form a substantially flat patient support surface and a second condition in which the first and second boards form an angular patient support surface, the hinge including a first plate connected to the first board, the first plate including at least two sockets, and a second plate connected to the second board, the second plate having at least two fingers extending into the sockets and pivotally connected to the second plate, and wherein the means reinforcing the hinged portion of the board includes the first and second plates;

a latch including a first latch portion connected to the first board and a second latch portion engageable with and disengageable from the second board when the first and second boards are in the first condition; and means reinforcing the hinged portion of the patient support board when the first and second patient support boards are in the first condition, for minimizing deflection of the hinged portion during application of cardiopulmonary resuscitation to a patient positioned on the patient support board.

8. The patient support board of claim 7 wherein:

the first latch portion includes a latch plate having a latch engaging surface;

a release member spring biased in a centered position and laterally moveable relative to the first board between the centered position and first and second positions and wherein the release member further has an arcuate groove having a pair of groove ends and a groove center;

the second latch portion includes a hook engageable with the latch plate engaging surface and a tip engageable with the arcuate groove, the tip disposed at the groove center when the release member is in the centered position and disengageable from the arcuate groove at one or the other of the groove ends when the release member is in the first or second position.

9. In a patient support board of the type for supporting a patient during emergency medical procedures, the improvement comprising:

a hinge connecting a first portion of the board to a second portion of the board such that at least one of the first and second board sections is moveable between a first condition in which the first and second board sections form a substantially flat patient support surface and a second condition in which the first and second board sections form an angular patient support surface, the hinge including:

a first plate connected to the first board section, the first plate including at least two sockets, and a second plate connected to the second board section, the second plate having at least two fingers extending into the sockets and pivotally connected to the second plate; and a latch including a first latch portion connected to the first board section and a second latch portion manually engageable with and disengageable from the second board section when the first and second board sections are in the first condition.

10. The patient support board of claim 9 wherein the hinge is located at a hinged portion of the board and wherein the improvement further comprises means reinforcing the hinged portion of the patient support board when the first and second patient support boards are in the first condition, for minimizing deflection of the hinged portion during application of cardiopulmonary resuscitation to a patient positioned on the patient support board.

11. A patient support board comprising:

a first board;

a second board hinged to the first board, at least one of the first and second boards moveable between a first condition in which the first and second boards form a substantially flat patient support surface and a second condition in which the first and second boards form an angular patient support surface; and a latch including a first latch portion connected to the first board and a second latch portion engageable with and disengageable from the second board when the first and second boards are in the first condition, the first latch portion automatically engageable with the second board upon movement of the first and second boards into the first condition.

* * * * *